US010617191B2

(12) United States Patent
Zhen

(10) Patent No.: US 10,617,191 B2
(45) Date of Patent: Apr. 14, 2020

(54) NAIL GEL REMOVAL METHOD

(71) Applicant: Lijuan Zhen, City of Industry, CA (US)

(72) Inventor: Lijuan Zhen, City of Industry, CA (US)

( * ) Notice: Subject to any disclaimer, the term of this patent is extended or adjusted under 35 U.S.C. 154(b) by 0 days.

(21) Appl. No.: 15/397,687

(22) Filed: Jan. 3, 2017

(65) Prior Publication Data

US 2018/0184781 A1 Jul. 5, 2018

Related U.S. Application Data

(60) Provisional application No. 62/438,439, filed on Dec. 22, 2016.

(51) Int. Cl.
*A45D 29/00* (2006.01)
*C11D 11/00* (2006.01)

(52) U.S. Cl.
CPC ..... *A45D 29/007* (2013.01); *C11D 11/0005* (2013.01)

(58) Field of Classification Search
None
See application file for complete search history.

(56) References Cited

U.S. PATENT DOCUMENTS

2012/0157561 A1* 6/2012 Gould ..... B41J 11/002 522/16
2013/0263875 A1* 10/2013 Burgess ..... A45D 29/00 132/200
2014/0326266 A1* 11/2014 Park ..... A45D 29/001 132/200
2015/0313831 A1* 11/2015 Li ..... A61K 8/40 424/61
2016/0030310 A1* 2/2016 Kozacheck ..... A61K 8/34 206/581

* cited by examiner

*Primary Examiner* — Jyothsna A Venkat
(74) *Attorney, Agent, or Firm* — Changi Wu; Changi Wu Law Office

(57) ABSTRACT

A nail gel removal method includes the steps of (a) absorbing warm water, which is water having a temperature higher than the room temperature, with the nail gel coated on the nail a user by soaking one or more nails in the warm water for three minutes or more; (b) softening the nail gel on the nail of the user until it is removable from the nail of the user; and (c) removing the softened nail gel from the nail of the user.

1 Claim, No Drawings

NAIL GEL REMOVAL METHOD

CROSS REFERENCE OF RELATED APPLICATION

This is a non-provisional application that claims the benefit of priority under 35U.S.C. § 120 to a provisional application, application No. 62/438,439, filed Dec. 22, 2016. The afore-mentioned provisional application is hereby incorporated by reference in its entireties.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention related to a nail coating, and more particularly to a method of removing nail coating from the user's finger nails.

Description of Related Arts

Gel nail polish is relative new in the market but has become really popular at nail salons and for nail painting enthusiasts in a short time. Various nail coatings are prepared and marketed in the current market, wherein the common nails coatings are classified into two categories: nail polishes, such as lacquers, varnish or enamels and artificial nails which are known as gels or acrylics. The composition of the nail polishes is various solid components which are dissolved in aromatic solvent. Upon application and drying, the nail polishes can be dried out by blowing or circulating hot or cold air on the nail coating for a specified period of time. However, the above mentioned nail polishes are easily to be scratched and are easily to chip out within few days.

One of the popular gel nail polishes is soft gel polish, which is often called as a soak off gel polish. The current soak off gel polish is long-lasting after applying on the nails, and always looks as new, wherein the soak off gel nails last on the nails for about 2 to 3 weeks without chipping, and they always look like they are just done. In addition, the soak off gel polish can be easily and directly painted on the natural nails in order to do the nail extension, and the user can easily change the color of the soak off gel nails by directly applying the traditional nail polish on the soak off gel nails.

Accordingly, the users need to initially apply the soak off base coat nail polish on their nails as a first layer, and then apply at least one layer of soak off gel nail polish thereon as a second or third layer. Accordingly, the users need to apply a top coat nail polish on the third or fourth layer. In particular, in order to dry each layer on the nail, the nail must be exposed under a LED light or a UV light. In addition, after each layer is dried, some wet sticky colloids will residue on the layer, so that the users must use alcohol to remove wet sticky colloids on each layer and to polish each layer after the following layer is applied. Therefore, the users need to spend at least 60 minutes to finish the four layers soak off gel polish structure, including the soak off gel nail polish applying time, drying time, and residue removing time.

Furthermore, the removing process of the soak off gel nails is inconvenience and troublesome. Since the structure of the soak off gel polish layer is hard (having at least three-layered structure), the user's soak off gel nails cannot be directly wiped off by using a rag, cotton, or tissue paper with the nail polish remover, so the user needs to saturate a piece of cotton ball in the nail polish remover and place it on each of the nails until the cotton makes contact with the entire nail surface, and uses the aluminum foil to wrap around the fingertips until the cotton balls firmly attach on the nails. Waiting for 5 to 7 minutes, a gap will naturally generate between each of the nails and the soak off gel polish layer thereof, and then the user can use cuticle pusher or iron pusher to pop the soak off gel polish layer off the nail. Accordingly, after the soak off gel polish layer is removed from each of the nails, some residue gel is residued on the nail, so that the user must use the nail file or nail buffer to completely remove the residue gel from the nail. For such removing process, the user has to spend at least 30 minutes to remove the soak off nail polish layer from their nails, and the nails will be damaged and thinned by frequently using the nail file or nail buffer.

SUMMARY OF THE PRESENT INVENTION

The invention is advantageous in that it provides a nail gel removal method which does not require to apply any chemical to the gel nail polish while the gel nail polish is able to be directly peeled or wiped off from the nails without complicated removing process.

Another advantage of the invention is to provide a nail gel removal method, wherein the removing process of the gel nail polish of the present invention is simple, so that no aluminum foils are needed to wrap around the fingertips, and also no additional auxiliary, such as a cuticle pusher or iron pusher, is needed to pop the gel nail polish layer off the nail.

Another advantage of the invention is to provide a nail gel removal method which is time-saving and money saving for the user. In other words, the damages for the nails are reduced during the gel nail polish removing process.

Another advantage of the invention is to provide a nail gel removal method, wherein no expensive and complicated procedure is required to be employed in the present invention in order to achieve the above mentioned advantages. Therefore, the present invention successfully provides an economic and efficient solution to simplify the removing process of the gel nail polish.

Additional advantages and features of the invention will become apparent from the description which follows, and may be realized by means of the instrumentalities and combinations particular point out in the appended claims. According to the present invention, the foregoing and other objects and advantages are attained by a nail gel removal method, comprising the steps of:

(a) absorbing warm water, which is water having a temperature higher than the room temperature, for example 30° C. or more, with the mail gel such as gel nail polish coated on finger nail a user by soaking one or more fingers in the warm water for three minutes or more;

(b) softening the nail gel on the finger nail of the user until it is wipable or peeling from the finger nail of the user; and (c) removing the softened nail gel from the finger nail of the user by hand or a tool, such as pusher to push the softened nail gel off.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Generally, a nail gel is a composition of oligomer, monomer and photoinitiator. It can be a composition for a visible light dryable nail coating, wherein the visible light dryable nail coating can be curved by any electromagnetic waves or particle beams. The composition of the visible light dryable nail coating comprises a base-acrylates copolymer, a photo-initiator, and a photo-initiator monomer.

Any one of several photo-initiators is used in the present invention, wherein the photo-initiators can be either component (A): visible light photo-initiator A or component (B): visible light photo-initiator B. Visible light photo-initiator A is, but not limited to, Bis (η5-2, 4-cylcopentadian-1-yl)-bis (2, 6-di-fluoro-3-(1H-pyrrol-1-yl) phenyl) titanium. Visible light photo-initiator A is a highly efficient orange colored photo-initiator with good thermal stability which is able to initiate UV and/or visible light polymerization of chemically unsaturated monomers and prepolymers, and belongs to the class of organometallic photo-initiator and can be used for both free-radical and cationic systems. More specifically, visible light photo-initiator A is particularly suitable for the curing of photopolymers for imaging or information storage applications where extremely high photosensitivity is required.

The following table 1 lists the specification of the visible light photo-initiator A of the first preferred embodiment of the visible light dryable nail coating according to this present invention.

TABLE 1

| Chemical Name | Appearance | Assay (HPLC) | Melting point | Volatiles |
|---|---|---|---|---|
| Visible light photo-initiator A | Yellow to orange powder | 99% min. | 180° C. min. | 0.5% max. |

The following table 2 lists the solubility of the visible light photo-initiator A of the first preferred embodiment of the visible light dryable nail coating according to this present invention.

TABLE 2

| Solubility | g in 100 ml solvent @25° C. |
|---|---|
| Acetone | 30 |
| Toluene | 10 |
| MEK | 30 |
| HDDA | 10 |
| Water | <0.5 |
| Butyl Acetate | 2 |

It is worth to mention that visible light photo-initiator A is sensitive to visible light and any exposure to sunlight must be avoided. And, the visible light photo-initiator A must be stored in low temperature, which is below 25° C., and dry environment. When visible light photo-initiator A is dissolved in a solvent or a formulation, it is extremely sensitive to daylight and light from standard fluorescence bulbs, so any open manipulation of visible light photo-initiator A must be carried out either in the dark or under light provided by a suitable red light sources. Therefore, opened drums are required to close after use to protect the product against light.

Accordingly, visible light photo-initiator B is, but not limited to, 4, 4'-Bis (diethylamino) benzophenone. Visible light photo-initiator B is both an aromatic ketone and a tertiary amine, and acts both as a photosensitizer and an amine synergist. It is worth to mention that visible light photo-initiator B has a strong absorption for a light source having a wavelength between 350 to 400 nm, which is the most suitable for pigmented and black UV coating, and is a photo-grade EMK which bears bright yellow color and is more resistant to oxidation by exposure in air than most commercially available EMK.

The following table 3 lists the chemical information of the visible light photo-initiator B of the first preferred embodiment of the visible light dryable nail coating according to this present invention.

TABLE 3

| | |
|---|---|
| EINECS No. | 202-025-4 |
| Molecular formula | $C_{21}H_{28}NO_2$ |
| Molecular weight | 324.4 |
| Physical Data | |
| Odor | Very faint |
| .ε @363 nm | $3.8 \times 104$ mL $mol^{-1}$ $cm^{-1}$ |

The following table 4 lists the specification of the visible light photo-initiator B of the first preferred embodiment of the visible light dryable nail coating according to this present invention.

TABLE 4

| | |
|---|---|
| Appearance | Off-white with blueish tint |
| Assay (HPLC) | 98% min. |
| Melting point | 92° C. min. |
| Solubility (3 g/10 mL Acetone) | Clear solution |

The following table 5 lists the solubility of the visible light photo-initiator B of the first preferred embodiment of the visible light dryable nail coating according to this present invention.

TABLE 5

| Solubility (% w/w @20° C.) | |
|---|---|
| Water | <0.01 |
| Acetone | 30 |
| Methanol | 7.0 |
| Toluene | 25 |
| Ethyl acetate | 24 |
| Butyl Acetate | 30 |

Accordingly, the usage rates of visible light photo-initiator B vary according to the composition of the system, source of light, line speed, and film thickness, and usually lie between 0.25% to 3% w/w together with photo-activators at 0.2-1.5% w/w, visible light photo-initiator B is especially suitable for applications where curing extent is critical but color of appearance is not essential such as for photoresist dry films. In addition, the use of visible light photo-initiator B in pigmented system, such as printing inks, results the increase of curing speed and surface drying.

According to the preferred embodiment of the present invention, the visible light dryable nail coating of the present invention can be curved by exposure to electromagnetic waves, which has wavelengths between 400-450 nm, wherein the electromagnetic waves can be natural light, including any kinds of light source in our daily life. Therefore, the visible light dryable nail coatings don't need to be dried out by air or any thermal dry device.

The photo-initiator monomer is adapted to provide the polymerized composition increased adhesion, wherein the photo-initiator monomer can be any type of monomer which is suitable for use within a composition for Forming a nail coating. In addition, the photo-initiator monomer can be, but not limited to, one or more of triethylene glycol dimethacrylate, hydroxypropyl methacrylate, isobornyl methacrylate, PEG-4 dimethacrylate, ethyl methacrylate, or dicyclopentadienylacrylate.

Alternatively, the nail gel such as gel nail polish is also adapted to being dried under an exposure of light. For example, the gel nail polish composition may comprise a gel nail polish mixture and a color agent mixing with the nail polish mixture. For example, the gel nail polish mixture comprises first through fourth chemical elements, wherein the first through fourth chemical elements are aliphatic urethane acrylate, polymer acrylate oligomer, propoxylated neopentyl glycol diacrylate which is a monomer as diluting agent, and trimethylbenzoyl diphenylphosphine oxide which is a photo initiator respectively. For example, an amount of the first chemical element (aliphatic urethane acrylate) has a range of 57.6-69.9% by weight. An amount of the second chemical element (polymer acrylate oligomer) has a range of 16.4-19.8% by weight. An amount of the third chemical element (diluting agent embodied as propoxylated neopentyl glycol diacrylate) has a range of 12.7-15.4% by weight. An amount of the fourth chemical element (photo initiator embodied as trimethylbenzoyl diphenylphosphine oxide) has a range of 4.1-4.9% by weight. In particular, a weight ratio of the first through fourth chemical elements is 63.5:18:14:4.5.

Accordingly, the gel nail polish mixture is a dryable mixture being dried under an exposure of LED light, UV light, or sunlight.

The gel nail polish as disclosed above can be manufactured by the following steps:

(1) Provide first through fourth chemical elements. Accordingly, the first through fourth chemical element and their weight ratio are described above. (2) Dissolve the first chemical element and the second chemical element into the third chemical element to form a first mixture. Accordingly, the first chemical element and the second chemical element are stirred into the third chemical element for a predetermined period of time under a predetermined temperature until the first chemical element and the second chemical element are well mixed into the third chemical element. The first chemical element and the second chemical element are preferably stirred into the third chemical element for 40 minutes under 60° C. in order to ensure the first chemical element and the second chemical element to be well-mixed into the third chemical element. In other words, the first and second chemical element are gradually heated up from room temperature to 60° C. when the first and second chemical element are added and dissolve into the third chemical element.

(3) Mix and stir the fourth chemical element into the first mixture to form a second mixture. In addition, the second mixture is stirred for a predetermined period of time under room temperature until the fourth chemical element is well-mixed into the first mixture. The second mixture is preferably stirred for 30 minutes under room temperature to ensure the fourth chemical element is well-mixed into the first mixture. It is worth mentioning that after the fourth chemical element is dissolved in the first mixture, the second mixture should be cooled down from 60° C. back to the room temperature.

(4) Add and mix the color agent into the second mixture to form a final product of the gel nail polish. Accordingly, the color agent contains color pigments to form the final product of the gel nail polish with a desired color.

(5) Fill the final product of the gel nail polish into a gel nail polish bottle and package the gel nail polish bottle with the gel nail polish therein, such that the gel nail polish is ready to use.

According to the preferred embodiment, before the step (4), the manufacturing method further comprises a step of filtering the second mixture to remove residues in the second mixture before the color agent is added thereinto. Accordingly, the second mixture is filtered by screen, such as a 200 mesh gauze screen, to ensure the standardized particle size of the third mixture.

As an example, the gel nail polish as disclosed above may be applied to the finger nail by the following steps:

(A) Apply a color coat of gel nail polish on the wipe off base coat layer.

(B) Dry the color coat of gel nail polish to form a gel nail polish layer.

(C) Apply a coat of gel nail polish top coat on the gel nail polish layer to form a top coat layer.

(D) Dry the gel nail polish top coat to form a finished gel nail polish structure, wherein when the gel nail polish top coat is dried, no wet sticky colloid is formed on the finished gel nail polish structure.

The gel nail polish layer and the top coat layer are completely dried, for example, under an exposure of LED light for 30 to 60 seconds, under an exposure of UV light for 2 minutes, or under an exposure of sunlight for 1 to 2 minutes.

If necessary, repeat the steps (D) and (E) to apply a second color coat of gel nail polish on the nail. The second coat is applied on the first gel nail polish layer after the first gel nail polish layer is dried. The second coat is dried under an exposure of light to integrally form the second layer on the first gel nail polish layer as one single layer structure. It is worth mentioning that the finished gel nail polish structure is three-layered or four-layered gel nail polish, which is determined by the number of color gel nail polish layer applied on the nails. It is worth mentioning that the finished gel nail polish structure can be kept on the nail for as long as 7 to 14 days as it is originally applied thereon.

Another type of nail gel is disclosed hereinafter as an example that the nail gel composition comprises a nail gel mixture and a color agent mixing with the nail gel mixture of chemical elements of resin, oligomer, monomer, photo initiator, and pigment. The nail gel mixture may comprise chemical elements including a first chemical element of resin or oligomer such as a compound of polyacrylate-15; a second chemical element of monomer; a third chemical element of photo initiator such as a compound of phenylbis (2,4,6-trimethylbenzoyl) phosphine oxide and 1-hydroxycyclohexyl phenyl ketone; a fourth chemical element of trimethylbenzoyl di-phenylphosphine oxide.

For example, the amount of the first chemical element has a range of 63-77% by weight. The amount of the second chemical element has a range of 11.7-14.3% by weight. The amount of the third chemical element has a range of 5.4-6.6% by weight. The amount of the fourth chemical element has a range of 2.7-3.3% by weight.

The nail gel mixture as disclosed above is a dryable mixture being dried under an exposure of LED light, UV light, or sunlight, which can be manufactured the following steps:

(1) Provide a nail gel which is a mixture of chemical elements of resin, oligomer, monomer, photo initiator, and/or pigment. In which, the nail gel mixture comprises the first through fourth chemical elements which are the compounds embodied above and their weight ratio is shown above.

(2) Mix and stir the second chemical element with the third chemical element together to form an initial first mixture. Accordingly, the second chemical element and the third chemical element are preferably stirred for 30 minutes under room temperature (25° C.) to form the first mixture.

(3) Dissolve the first chemical element into the first mixture by heating and stirring the first chemical element in the first mixture to form a second mixture. Accordingly, the second mixture is preferably stirred for 40 minutes under 60° C. in order to ensure the first chemical element to be dissolved in the first mixture. In other words, the first mixture is gradually heated up from room temperature to 60° C. when the first chemical element is added and dissolved into the first mixture.

(4) Mix and stir the fourth chemical element into the second mixture to form a third mixture. Accordingly, the fourth chemical element is added into the second mixture. In addition, the third mixture is preferably stirred for 30 minutes under room temperature to ensure the fourth chemical element is well-mixed into the second mixture. It is worth mentioning that after the first chemical element is dissolved in the first mixture, the second mixture should be cooled down from 60° C. back to the room temperature in order to mix with the fourth chemical element.

(5) Add and mix the color agent into the third mixture to form a final product of the single step peeling off light nail gel. Accordingly, the color agent contains color pigments to form the final product of the nail gel with a desired color.

(6) Fill the final product of the nail gel into a nail gel bottle and package the nail gel bottle with the nail gel therein, such that the nail gel is ready to use.

According to the preferred embodiment, before the step (5), the manufacturing method further comprises a step of filtering the third mixture to remove residues in the third mixture before the color agent is added thereinto. Accordingly, the third mixture is filtered by screen, such as a 200 mesh gauze screen, to ensure the standardized particle size of the third mixture.

The nail gel, such as gel nail polish, as disclosed above can be applied in the following steps.

(A) Apply a coat of nail gel on the nail, wherein the nail gel is a mixture of chemical elements of resin, oligmer, monomer, photo initiator and/or pigment. The user is able to apply a coat of nail gel from the nail gel bottle via a conventional method. It is worth mentioning that no base coating and/or top polish coating is required before and after the nail gel layer is formed on the nail.

(B) Dry the coat under an exposure of light, having a light wave between 385-405 nm, to form the nail gel layer for 30 to 120 seconds, wherein when the layer is cured and dried, no wet sticky colloid is formed on the layer. The layer is completely dried under an exposure of LED light (395-405 nm light wave length) for 30 to 60 seconds, under an exposure of UV light (385 nm light wave length) for 2 minutes, or under an exposure of natural sunlight (containing light wave from 385405 nm) for 1 to 2 minutes.

In other words, the nail gel can be completely cured and dried out on the nails after exposing under a light, such as UV light, LED light and natural sunlight, having light wave 385-405 nm, within 30 seconds to 120 seconds, with glossy shine surface lasting 10 days or more and without any wet sticky residue on the nail surfaces.

If necessary, the users may repeat the steps (A) and (B) to apply a second coat of nail gel on the nail for thicker coating effect. The second coat is applied on the first layer after the first layer is dried. The second coat is also dried under an exposure of light to integrally form the second layer on the first layer as one single layer structure. The double layered nail gel is opaque and makes the color more intense and even on the nail. It is worth mentioning that no more than two layers of nail gel are required to apply since two layers of nail gel of the present invention is already better than four layers of conventional nail polish.

According to a preferred embodiment of the present invention, a nail gel, including but not limited to gel nail polish, for example the two kinds of nail gel as disclosed above or any other kinds, can be removed from the finger nail of the user by a removal method that comprises the steps of:

(a) absorbing warm water, which is water having a temperature higher than the room temperature, such as 30° C. or more, with the nail gel coated on the nail a user by soaking one or more nails in the warm water for 3 minutes or more;

(b) softening the nail gel on the nail of the user until it is removable from the nail of the user; and (c) removing the softened nail gel from the nail of the user.

In the step (a), the user may simply immerse her finger nails or toe nails in warm water received in a container or wrap her finger nails by material such as foam material, tower, cloth, soaked with warm water. Preferably, the nail gel coated on finger nails or toe nails absorbs warm water by immersing the user's hand or foot into a container of warm water while all nails are surrounded by the warm water, wherein the preferred temperature of the water is 40° C.-80° C. for preferably 3 to 30 minutes, depending on the thickness and ingredients of the nail gel on the nail.

In the step (b), the soaking time of the nail gel depends on the thickness of the nail gel coated on the finger nail until the nail gel is softened by the warm water. It is worth mentioning that the warm water in the container is preferred to maintain a constant temperature above 30° C. or at least keep between 30° C. to 80° C. during the soaking time. When the user finds the nail gel on the nail being softened by the warm water until it is detachable from the nail, the soaking step (b) is completed.

Then, the user may simply remove the softened nail gel from the nail by peeling or wiping off from the nail. The user may directly peel off the nail gel on the nail, preferably peeling off the whole piece or in several pieces manner. The nail gel on the nail can be directly peeled off by hand without any supplemental tool. Accordingly, the entire layer of nail gel can be slowly peeled off starting from an edge of the nail. It is worth mentioning that if the nail gel is colorless, the peeled off nail gel piece is transparent too. The user may also remove the softened nail gel by a tool such as pusher to push it off the nail.

It is appreciated that the nail gel removal method of the present invention enables the nail gel to be directly peeled off from the nails without using nail gel remover or nailfile, so the nail gel can prevent the damage of the nails causing by using the nail gel remover or the gliding action of the nailfile. And, the user can save lots of money without purchasing nail gel removers.

According to the preferred embodiment, the gel nail is able to be directly removed by wiping, peeling or pushing off from the nail without using the aluminum foil to wrap around the fingertips with the cotton balls saturated with the nail polish remover, so that the user can prevent spending lots of time to wait until a gap generated between the nails and the finished gel nail polish structure. Practically, even though a pusher may be used to push off the softened nail gel, the user may also not to use cuticle pusher or iron pusher to pop the gel nail polish layer off the nail that can prevent the nails being uneven and not smooth. In addition, the user also doesn't need to nail file or nail buffer to completely remove the residue gel from the nail, so as to prevent the nails being thinner. In other words, the removing process of the gel nail polish of the present invention can dramatically reduce the damage happened on the nails as by the conventional way.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of removing a nail gel applied on a nail, comprising the steps of:

(a) absorbing warm water, having a temperature from 30° C. to 80° C., with the nail gel on a nail a user by soaking the nail in the warm water for a predetermined soaking time from 3 minutes to 30 minutes;

(b) softening the nail gel on the nail of the user until it is removable from the nail of the user by the warm water; and (c) removing the softened nail gel from the nail of the user, wherein the nail gel is a mixture comprises first through fourth chemical elements, wherein the first through fourth chemical elements are aliphatic urethane acrylate, polymer acrylate oligomer, propoxylated neopentyl glycol diacrylate which is a monomer as diluting agent, and trimethylbenzoyl diphenylphosphine oxide which is a photo initiator respectively, wherein an amount of the first chemical element has a range of 57.6-69.9% by weight, an amount of the second chemical element has a range of 16.4-19.8% by weight, an amount of the third chemical element has a range of 12.7-15.4% by weight, and an amount of the fourth chemical element has a range of 4.1-4.9% by weight.

* * * * *